US008537060B2

(12) United States Patent
Chung

(10) Patent No.: US 8,537,060 B2
(45) Date of Patent: Sep. 17, 2013

(54) GLASS ANTENNA FOR CAR

(75) Inventor: Tae Inn Chung, Pohang-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 424 days.

(21) Appl. No.: 12/424,870

(22) Filed: Apr. 16, 2009

(65) Prior Publication Data

US 2009/0262032 A1 Oct. 22, 2009

(30) Foreign Application Priority Data

Apr. 16, 2008 (KR) ..... 10-2008-0035323

(51) Int. Cl.
*H01Q 1/32* (2006.01)

(52) U.S. Cl.
USPC ..... 343/713; 343/712; 343/711

(58) Field of Classification Search
USPC ..... 343/713, 711–13
See application file for complete search history.

(56) References Cited

U.S. PATENT DOCUMENTS 5,293,174 A * 3/1994 Kropielnicki et al. ..... 343/713
5,521,606 A * 5/1996 Iijima et al. ..... 343/713
5,581,263 A * 12/1996 Maeda et al. ..... 343/704
5,952,977 A * 9/1999 Taniguchi et al. ..... 343/713
2001/0038355 A1* 11/2001 Fuchs et al. ..... 343/713

FOREIGN PATENT DOCUMENTS

| | | |
|---|---|---|
| JP | 08-018318 | 1/1996 |
| JP | 2001-251120 | 9/2001 |
| JP | 2002-185230 A | 6/2002 |
| JP | 2003-017920 A | 1/2003 |
| JP | 2004-072419 | 3/2004 |
| JP | 2006-173658 A | 6/2006 |
| KR | 2001-0076363 | 8/2001 |
| KR | 2002-0034006 | 5/2002 |
| KR | 2004-0000513 | 1/2004 |
| KR | 2006-0013754 | 2/2006 |
| KR | 2007-0044906 | 5/2007 |
| KR | 2007-0113128 | 11/2007 |

* cited by examiner

*Primary Examiner* — Douglas W Owens
*Assistant Examiner* — Jennifer F Hu
(74) *Attorney, Agent, or Firm* — Edwards Wildman Palmer LLP; Peter F. Corless; Stephen D. LeBarron

(57) ABSTRACT

A glass antenna of a vehicle is provided, in which the pattern of the antenna is positioned at the sealant provided between a window glass and the vehicle body for indirect grounding. With this, the impedance characteristic and reception level of the antenna can be increased in a cost-effective way.

11 Claims, 5 Drawing Sheets

| | 88Mhz | 93Mhz | 98Mhz | 103Mhz | 108Mhz |
|---|---|---|---|---|---|
| FM 1 |  |  |  |  |  |
| reception level | 54.8dBuV | 58dBuV | 56.3dBuV | 54.5dBuV | 57.5dBuV |
| FM 2 |  |  |  |  |  |
| reception level | 47.1dBuV | 52.8dBuV | 50.3dBuV | 49.4dBuV | 52.8dBuV |

| | 88Mhz | 93Mhz | 98Mhz | 103Mhz | 108Mhz |
|---|---|---|---|---|---|
| FM 1 |  |  |  |  |  |
| reception level | 57.6dBuV | 59dBuV | 58dBuV | 58.6dBuV | 59.4dBuV |
| FM 2 |  |  |  |  |  |
| reception level | 52.6dBuV | 55.2dBuV | 54.5dBuV | 52.5dBuV | 52.4dBuV |

GLASS ANTENNA FOR CAR

CROSS-REFERENCE TO RELATED APPLICATION

This application claims under 35 U.S.C. §119(a) the benefit of Korean Patent Application No. 10-2008-0035323 filed on Apr. 16, 2008, the entire contents of which are incorporated herein by reference.

BACKGROUND

The present disclosure relates to a glass antenna of a vehicle. Generally, an antenna of a vehicle for receiving radio broadcasts can be classified into a pole antenna which is realized as a metallic bar protruding from an outer panel of a vehicle body and a glass antenna which is provided as a built-in antenna.

Typically, the glass antenna is made in such a manner that a thin conducting glass antenna having a thickness of about 0.3 mm or less is inserted into a laminated glass intermediate layer, or a pattern of an antenna is printed in the surface of a window glass of a vehicle.

The window glass in which the pattern of an antenna is installed is surrounded by one or more outer panels of the vehicle body, which are conductive. As a result, the window glass has a spatial restriction in installation of the pattern. Therefore, there is a need for technology capable of enhancing the impedance characteristic and reception sensitivity of the pattern of the window glass antenna.

The above information disclosed in this the Background section is only for enhancement of understanding of the background of the invention and therefore it may contain information that does not form the prior art that is already known in this country to a person of ordinary skill in the art.

SUMMARY

The glass antenna of a vehicle according to the present invention has an antenna pattern including a grounding unit thereof positioned at a sealant which is provided between the edge of a window glass of the vehicle and a body portion thereof such that the grounding unit is indirectly grounded to the vehicle body.

In case of a diversity antenna including an FM1 antenna pattern and an FM2 antenna pattern which are formed separately, the antenna pattern may be formed in such a manner that the FM2 antenna pattern which is not connected with a hotwire includes the grounding unit grounded through the sealant. Preferably, the sealant is made of a rubber material. Suitably, the length of the grounding unit may set to be $\lambda/4$ ($\lambda$ is wavelength). Preferably, the glass antenna of a vehicle of claim 1, wherein the sealant includes bonding material.

With this, the impedance characteristic and reception level of an antenna can be improved.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other features of the present invention will now be described in detail with reference to certain exemplary embodiments thereof illustrated by the accompanying drawings which are given hereinafter by way of illustration only, and thus are not limitative of the present invention, and wherein.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use in the environment.

DETAILED DESCRIPTION OF EMBODIMENTS

Hereinafter, exemplary embodiments of the present invention will be described in detail with reference to the attached drawings Glass antennas according to the present invention can be installed on the front, side or rear window glasses of a vehicle. Solely for the purposes of illustration and simplicity, glass antennas installed on the rear window glass are described here.

A glass antenna can be classified into a single antenna and a diversity antenna. The single antenna is comprised of an AM antenna pattern and an FM antenna pattern. The diversity antenna is comprised of an AM antenna pattern, an FM1 antenna pattern and an FM2 antenna pattern.

Figure 1:
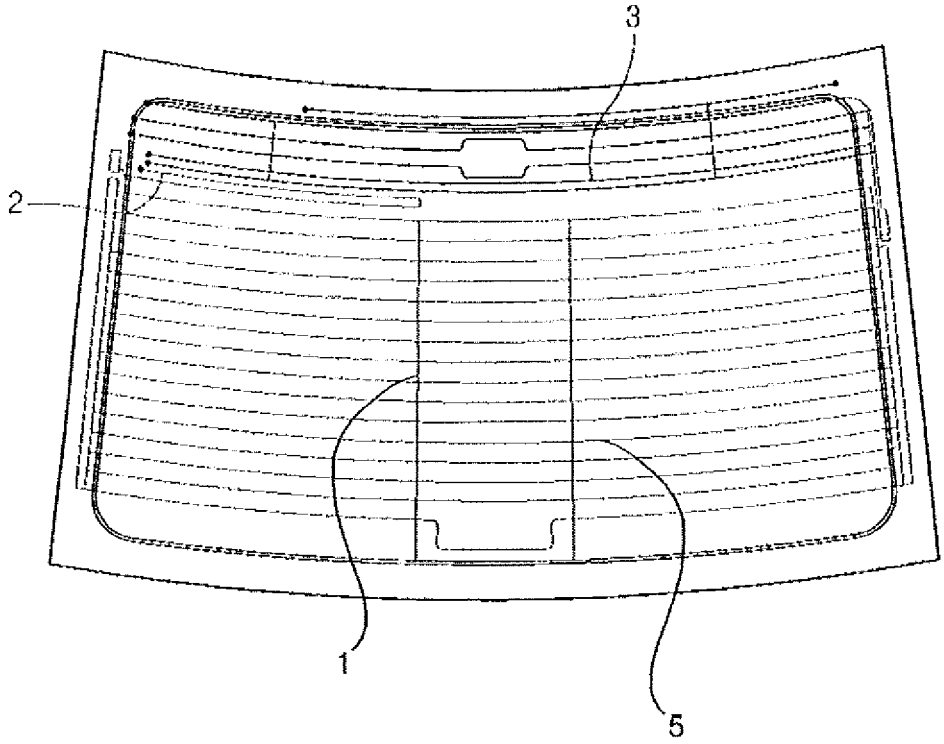
FIG. 1 is a schematic diagram showing a configuration of a diversity glass antenna of a vehicle.

FIG. 1 schematically shows a configuration of a diversity glass antenna.

As shown in FIG. 1, the diversity glass antenna includes an antenna pattern 3 for AM reception and an antenna pattern for FM reception, which FM antenna pattern includes an FM1 antenna pattern 1 and an FM2 antenna pattern 2 separately formed from the FM1 antenna pattern 1.

A MICOM provided within a diversity module measures the intensity of an output final stage of the signals that the FM1 antenna pattern 1 or the FM2 antenna pattern 2 receives. The MICOM selects the strongest signal among the measured signals by a diversity switching circuit of the module and outputs the signal. In the meantime, the MICOM can synthesize the signal of the FM1 antenna pattern 1 and that of the FM2 antenna pattern 2 and output the synthesized signal.

Figure 2:
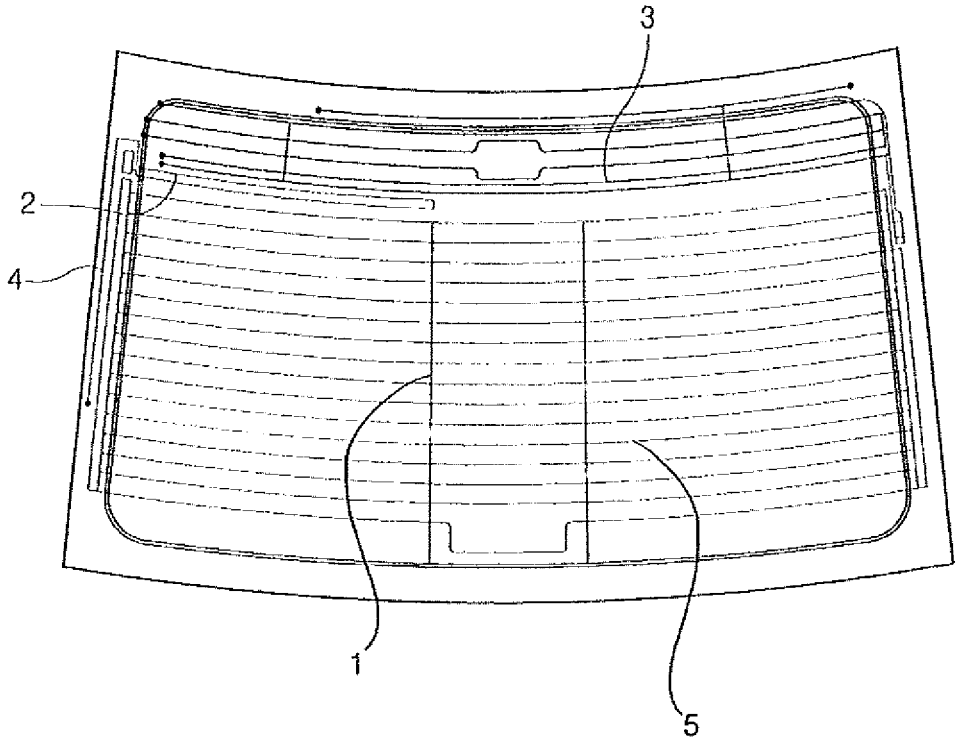
FIG. 2 is a schematic diagram showing a configuration of a glass antenna according to an embodiment of the present invention.

FIG. 2 schematically shows a configuration of a glass antenna according to an embodiment of the present invention.

As shown in FIG. 2, the glass antenna includes an antenna pattern and a grounding unit 4.

Preferably, the antenna pattern is nearly non-directional. In the case of a single antenna, the antenna pattern includes an AM antenna pattern (not shown) and an FM antenna pattern (not shown). In the case of a diversity antenna, the antenna pattern includes an AM antenna pattern 3, an FM1 antenna pattern 1 and an FM2 antenna pattern 2.

Figure 3:
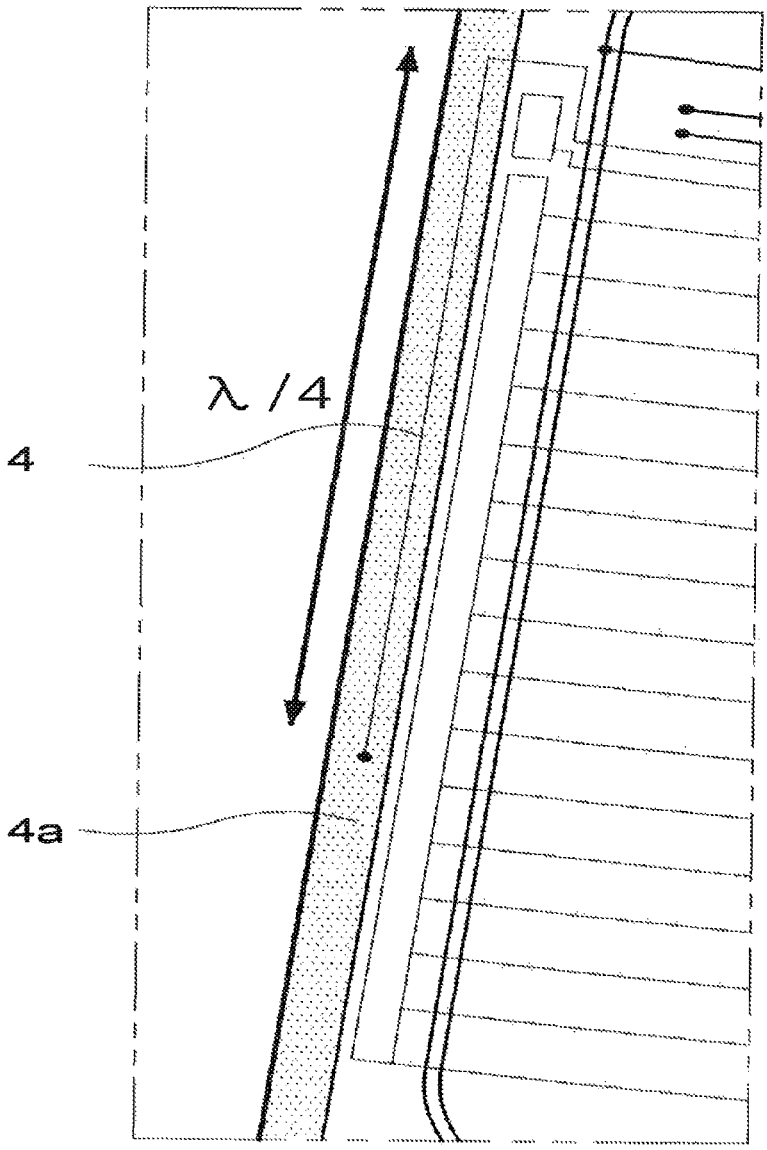
FIG. 3 is a schematic diagram showing a configuration of a glass antenna according to an embodiment of the present invention, in which a ground of FM2 of the glass antenna is formed in the sealant.

As shown in FIG. 3, the rear window of a vehicle in which an antenna pattern is installed has a sealant 4*a* of rubber material at its edge, by which the rear window can be fixed and sealed tightly to the vehicle body. The sealant includes bonding material.

The grounding unit 4, a part of the antenna pattern, is grounded through the sealant 4*a*. Preferably, in the case of a single antenna, the length of the grounding unit 4 may be $\lambda/4$ from the end of the FM antenna pattern. Preferably, in the case of a diversity antenna, the length of the grounding unit 4 may be $\lambda/4$ from the end of the FM2 antenna pattern 2.

Considering that the bandwidth of the FM frequency of a radio ranges from, e.g., 88 Mhz to 108 Mhz, the length of the grounding unit pattern for grounding is calculated to obtain the length of $\lambda/4$. At this time, the length of $\lambda/4$ of the pattern is approximately 70 cm to 90 cm.

The grounding unit 4 is, suitably, bonded with the sealant 4*a* to be integrated in a vertical direction. The reason that the grounding unit 4 of the FM2 antenna pattern 2 is bonded with the sealant 4*a* to be integrated in a vertical direction is as follows.

The grounding unit 4 of the FM2 antenna pattern 2 has to be in contact with the sealant 4*a* of the upper end or lower end of the window glass if the grounding unit 4 is provided induced in the horizontal direction. At this time, the FM2 antenna pattern 2 should avoid the AM antenna pattern 3 and the FM1 antenna pattern 1 which are positioned on the upper portion and lower portion of the FM2 antenna pattern 2.

As a result, the induction length for grounding needs to be long so that the grounding unit 4 can be in contact with the upper end or lower end of the window glass. The induction length for grounding can be reduced by bonding the grounding unit 4 with the sealant 4*a* to be integrated in a vertical direction.

In the meantime, the FM2 antenna pattern 2 is indirectly grounded through the sealant 4*a* with the above-described bonding. With this, costs can be saved compared to a case where wiring is drawn to directly ground the antenna pattern to the body of vehicle.

Here, the reason for indirectly grounding the FM2 antenna pattern 2, rather than the FM1 antenna pattern 1, through the sealant is as follows.

Since the FM1 antenna pattern 1 is connected with a hotwire, the reception sensitivity can be degraded due to noise generated in the hotwire 5 such that it is not suitable for grounding.

Moreover, when the grounding unit 4 formed in the FM2 antenna pattern 2 is grounded through the sealant 4*a*, the impedance characteristic and the FM reception level can be improved for the FM1 antenna pattern 1 as well as the grounded FM2 antenna pattern 2 due to the coupling effect of the FM2 antenna pattern 2 with the FM1 antenna pattern 1.

Figure 4:
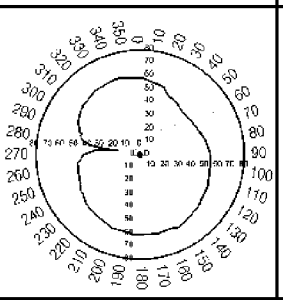
FIG. 4 is a graph showing the reception level of a conventional diversity glass antenna.
Figure 4:
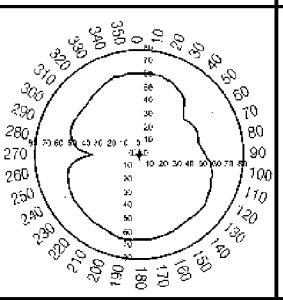
Figure 4:
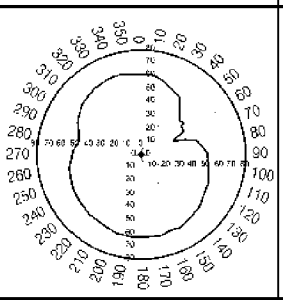
Figure 4:
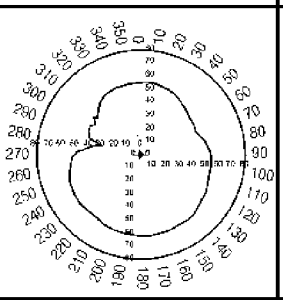
Figure 4:
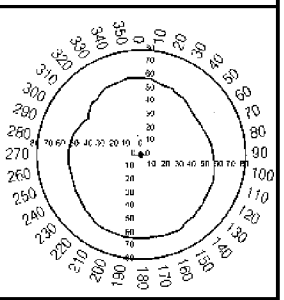
Figure 4:
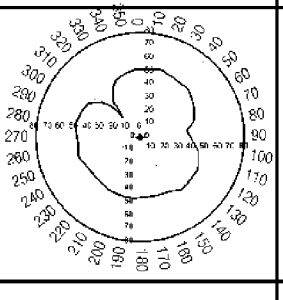
Figure 4:
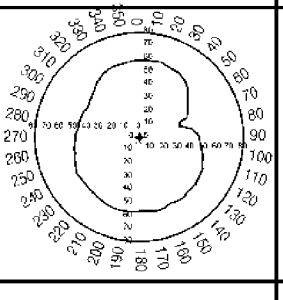
Figure 4:
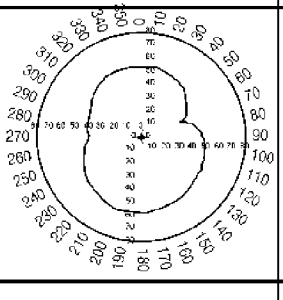
Figure 4:
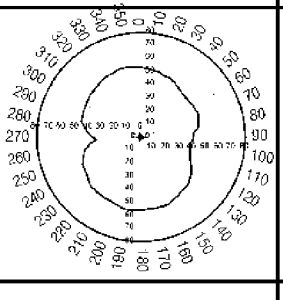
Figure 4:
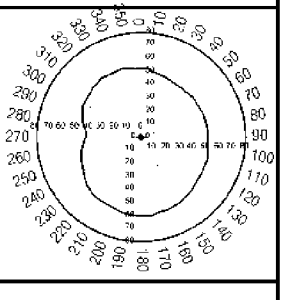
Figure 5:
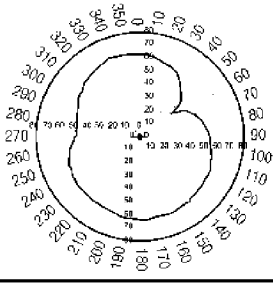
FIG. 5 is a graph showing the reception level of a diversity glass antenna according to an embodiment of the present invention.
Figure 5:
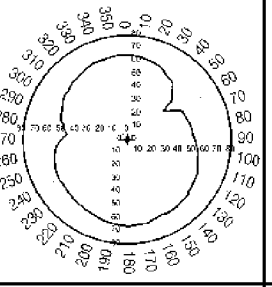
Figure 5:
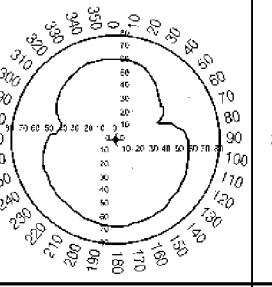
Figure 5:
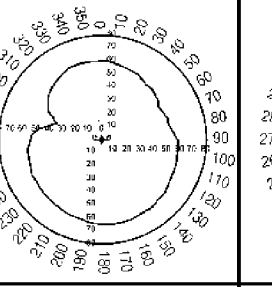
Figure 5:
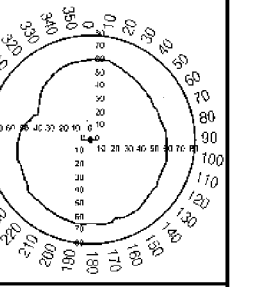
Figure 5:
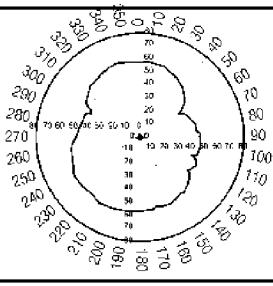
Figure 5:
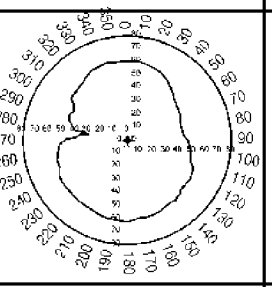
Figure 5:
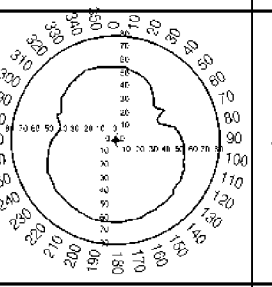
Figure 5:
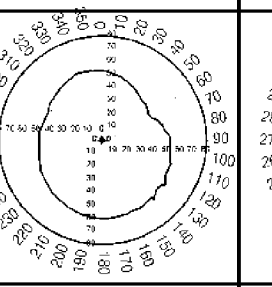
Figure 5:
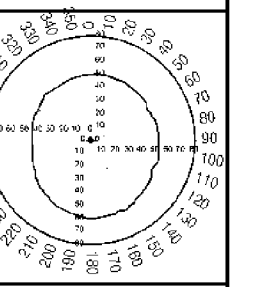

FIGS. 4 and 5 show the reception level of a conventional diversity glass antenna and a diversity glass antenna according to an embodiment of the present invention, respectively.

As shown in FIGS. 4 and 5, the reception levels of the FM1 glass antenna 1 and the FM2 glass antenna 2 of the diversity glass antenna according to an embodiment of the present invention are increased by 3 dBuV on average due to the indirect grounding through the sealant 4*a* of the grounding unit 4.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A glass antenna of a vehicle, comprising:

an AM antenna pattern formed on at least a first portion of a window glass of the vehicle;

an FM1 antenna pattern formed separately from the AM antenna pattern on at least a second portion of the window glass; and an FM2 antenna pattern formed separately from the AM antenna pattern and the FM1 antenna pattern in at least a third portion of the window glass, the FM2 antenna pattern including a grounding unit connected to the FM2 antenna pattern which is bonded with a sealant provided between an edge of a window glass in the vehicle and a body portion of the vehicle such that the grounding unit is indirectly grounded to the vehicle body portion through the sealant, wherein the grounding unit is bonded with the sealant to reduce an induction length for grounding, wherein the FM1 antenna pattern is connected to a hotwire and the FM2 antenna pattern is not connected with the hotwire.

2. The glass antenna of a vehicle of claim 1, wherein the sealant is made of a rubber material.

3. The glass antenna of a vehicle of claim 1, wherein the length of the grounding unit is $\lambda/4$ wherein $\lambda$ is wavelength and the wavelength corresponds to frequency ranges from 88 Mhz-108 Mhz.

4. The glass antenna of a vehicle of claim 3, wherein the length of the grounding unit is in a range of 70 cm-90 cm.

5. The glass antenna of a vehicle of claim 1, wherein the sealant includes bonding material.

6. The glass antenna of a vehicle of claim 5, wherein the sealant is a rubber material.

7. The glass antenna of a vehicle of claim 6, wherein the grounding unit is bonded with the sealant to be integrated in a vertical direction.

8. The glass antenna of the vehicle of claim 1, wherein the glass antenna is installed on a side window of the vehicle.

9. The glass antenna of the vehicle of claim 1, wherein the glass antenna is installed on a rear window of the vehicle.

10. The glass antenna of a vehicle of claim 1, wherein the grounding unit is formed such that the FM reception level is improved due to the coupling effect among the FM1 antenna pattern, the FM2 antenna patter, and the grounding unit.

11. A glass antenna of a vehicle, comprising an FM1 antenna pattern connected to a hotwire;

an FM2 antenna pattern which is not connected with a hotwire, the FM1 and FM2 antenna pattern formed separately from each other; and a grounding unit of the FM2 antenna pattern positioned within a sealant provided between an edge of a window glass of the vehicle and a body portion of the vehicle such that the grounding unit is indirectly grounded to the vehicle body portion through the sealant, wherein the grounding unit is bonded to the sealant to reduce an induction length for grounding.

* * * * *